US009570057B2

(12) United States Patent
Brown

(10) Patent No.: US 9,570,057 B2
(45) Date of Patent: Feb. 14, 2017

(54) AUDIO SIGNAL PROCESSING METHODS AND SYSTEMS

(71) Applicant: Matthew Brown, Coogee (AU)

(72) Inventor: Matthew Brown, Coogee (AU)

( * ) Notice: Subject to any disclaimer, the term of this patent is extended or adjusted under 35 U.S.C. 154(b) by 0 days.

(21) Appl. No.: 14/804,042

(22) Filed: Jul. 20, 2015

(65) Prior Publication Data

US 2016/0019878 A1 Jan. 21, 2016

(30) Foreign Application Priority Data

Jul. 21, 2014 (AU) ..... 2014204540

(51) Int. Cl.

| | |
|---|---|
| ***H04R 3/04*** | (2006.01) |
| ***G10L 25/18*** | (2013.01) |
| ***G10H 1/02*** | (2006.01) |
| ***G10H 1/12*** | (2006.01) |
| ***G10H 1/38*** | (2006.01) |

(52) U.S. Cl.

CPC ..... *G10H 1/125* (2013.01); *G10H 1/383* (2013.01); *G10L 25/18* (2013.01); *G10H 2210/041* (2013.01); *G10H 2210/066* (2013.01); *G10H 2210/081* (2013.01); *G10H 2210/086* (2013.01); *G10H 2250/215* (2013.01); *G10H 2250/225* (2013.01); *G10H 2250/235* (2013.01); *G10H 2250/251* (2013.01); *G10H 2250/285* (2013.01); *H04R 3/04* (2013.01)

(58) Field of Classification Search

CPC .. H04S 2420/01; H04S 2400/01; H04S 3/008; H04R 3/00; H04R 3/04; H04R 3/005; H04R 5/02; G10L 19/02; G10L 19/008; G10L 19/0204; G10L 21/00; G10L 21/0208; G10L 25/18; G10H 1/125; G10H 1/383; G10H 2210/041; G10H 2210/066; G10H 2210/086; G10H 2250/215; G10H 2250/225; G10H 2250/235; G10H 2250/251; G10H 2250/285

See application file for complete search history.

(56) References Cited

U.S. PATENT DOCUMENTS

| | | | |
|---|---|---|---|
| 5,501,130 A | 3/1996 | Gannon | |
| 7,919,707 B2 | 4/2011 | Harvey | |
| 8,473,283 B2 | 6/2013 | Master | |
| 2003/0023421 A1 | 1/2003 | Finn | |
| 2006/0004566 A1* | 1/2006 | Oh | G10L 19/0017 704/200.1 |

(Continued)

FOREIGN PATENT DOCUMENTS

AU 2014204540 B1 8/2015

OTHER PUBLICATIONS

A. Klapuri, Automatic music transcription as we know it today, Journal of New Music Research, vol. 33, No. 3, pp. 269-282, 2004.

(Continued)

*Primary Examiner* — Thang Tran

(74) *Attorney, Agent, or Firm* — Andrew F. Young, Esq.; Lackenbach Siegel, LLP

(57) ABSTRACT

Described are methods and systems of identifying one or more fundamental frequency component(s) of an audio signal. The methods and systems may include any one or more of an audio event receiving step, a signal discretization step, a masking step, and/or a transcription step.

21 Claims, 4 Drawing Sheets

(56) References Cited

U.S. PATENT DOCUMENTS

| | | | | |
|---|---|---|---|---|
| 2009/0119097 | A1 | 5/2009 | Master | |
| 2012/0095755 | A1* | 4/2012 | Otani | G10L 21/0208 704/205 |
| 2012/0101813 | A1* | 4/2012 | Vaillancourt | G10L 19/20 704/206 |
| 2012/0288124 | A1* | 11/2012 | Fejzo | H04R 5/02 381/303 |
| 2013/0182862 | A1 | 7/2013 | Disch | |
| 2013/0216053 | A1 | 8/2013 | Disch | |
| 2013/0226570 | A1* | 8/2013 | Multrus | G10L 19/0204 704/219 |
| 2014/0142959 | A1 | 5/2014 | Chubarev | |
| 2015/0030171 | A1* | 1/2015 | Hashimoto | H04R 3/04 381/66 |
| 2015/0317995 | A1* | 11/2015 | De Vries | G10L 19/02 704/206 |
| 2016/0148620 | A1* | 5/2016 | Bilobrov | G10L 19/018 704/270 |

OTHER PUBLICATIONS

R. Liu, N. Griffth, J. Walker, and P. Murphy, Time domain note average energy based music onset detection in Proceedings of the Stockholm Music Acoustics Conference, vol. 2003, 2003, pp. 7-10.
P. M. Brossier, Automatic annotation of musical audio for interactive applications, Ph.D. dissertation, 2006.
A. M. Noll, Pitch determination of human speech by the harmonic product spectrum, the harmonic sum spectrum, and a maximum likelihood estimate, in Proceedings of the symposium on computer processing communications, vol. 779, 1969.
L. Rabiner, M. Cheng, A. Rosenberg, and C. McGonegal, A comparative performance study of several pitch detection algorithms, Acoustics, Speech and Signal Processing, IEEE Transactions on, vol. 24, No. 5, pp. 399-418, 1976.
J. P. Bello, G. Monti, M. Sandler et al., Techniques for automatic music transcription, in International Symposium on Music Information Retrieval, 2000, pp. 23-25.
J. C. Licklider, a duplex theory of pitch perception, Cellular and Molecular Life Sciences, vol. 7, No. 4, pp. 128-134, 1951.
M. Slaney, Auditory toolbox, Interval Research Corporation, Tech. Rep, vol. 10, p. 1998, 1998.
D. P. Ellis, Prediction-driven computational auditory scene analysis, Ph.D. dissertation, Massachusetts Institute of Technology, 1996.
R. Meddis and L. O'Mard, A unitary model of pitch perception, The Journal of the Acoustical Society of America, vol. 102, p. 1811, 1997.
T. Tolonen and M. Karjalainen, A computationally efficient multipitch analysis model, Speech and Audio Processing, IEEE Transactions on, vol. 8, No. 6, pp. 708-716, 2000.
A. Klapuri, Multipitch analysis of polyphonic music and speech signals using an auditory model, Audio, Speech, and Language Processing, IEEE Transactions on, vol. 16, No. 2, pp. 255-266, 2008.
M. Marolt, Networks of adaptive oscillators for partial tracking and transcription of music recordings, Journal of New Music Research, vol. 33, No. 1, pp. 49-59, 2004.
J. P. Bello and M. Sandler, Blackboard system and top-down processing for the transcription of simple polyphonic music, in Proceedings of the COST G-6 Conference on digital Audio Effects (DAFX-00), 2000.
Z. Duan, Y. Zhang, C. Zhang, and Z. Shi, Unsupervised single-channel music source separation by average harmonic structure modeling, Audio, Speech, and Language Processing, IEEE Transactions on, vol. 16, No. 4, pp. 766-778, 2008.
J. P. Bello, L. Daudet, and M. B. Sandler, Automatic piano transcription using frequency and time-domain information, Audio, Speech, and Language Processing, IEEE Transactions on, vol. 14, No. 6, pp. 2242-2251, 2006.
W.-C. Chang, A. W. Su, C. Yeh, A. Roebel, and X. Rodet, Multiple-FO tracking based on a high-order HMM model, in Proc. DAFx, 2008.
B.-H. Juang and L. R. Rabiner, Hidden Markov models for speech recognition, Technometrics, vol. 33, No. 3, pp. 251-272, 1991.
Alain de Cheveigne and Hideki Kawahara YIN, a fundamental frequency estimator for speech and music in the Journal of the Acoustical Society of America, vol. 111, p. 1917, 2002.
G. Monti and M. Sandler, Monophonic transcription with autocorrelation, in Proceedings of the COST G-6 Conference on digital audio effects (DAFX-00), Verona, Italy, 2000, pp. 257-260.
S. H. Nawab, S. A. Ayyash, and R. Wotiz, Identification of musical chords using constant-Q spectra, in Acoustics, Speech, and Signal Processing, 2001. Proceedings.(ICASSP'01). 2001 IEEE International Conference on, vol. 5. IEEE, 2001, pp. 3373-3376.
T. Matsuoka and K. Ito, Perception of missing fundamental and consideration on its characteristics, in Engineering in Medicine and Biology Society, 2003. Proceedings of the 25th Annual International Conference of the IEEE, vol. 3. IEEE, 2003, pp. 2059-2062.
J. C. Smith, J. T. Marsh, S. Greenberg, and W. S. Brown, Human auditory frequency following responses to a missing fundamental, Science, vol. 201, No. 4356, pp. 639-641, 1978.
M. Marolt, Transcription of polyphonic piano music with neural networks, in Electrotechnical Conference, 2000. MELECON 2000. 10th Mediterranean, vol. 2. IEEE, 2000, pp. 512-515.
M. Marolt A connectionist approach to automatic transcription of polyphonic piano music, Multimedia, IEEE Transactions on, vol. 6, No. 3, pp. 439-449, 2004.
G. Monti and M. Sandler, Automatic polyphonic piano note extraction using fuzzy logic in a blackboard system, in Proceedings of the 5th International Conference on Digital Audio Effects (DAFx-02), 2002, pp. 26-28.
W. Lao, E. T. Tan, and A. H. Kam, Computationally inexpensive and effective scheme for automatic transcription of polyphonic music, in Multimedia and Expo, 2004. ICME'04. 2004 IEEE International Conference on, vol. 3. IEEE, 2004, pp. 1775-1778.
H. Takeda, N. Saito, T. Otsuki, M. Nakai, H. Shimodaira, and S. Sagayama, Hidden Markov model for automatic transcription of midi signals, in Multimedia Signal Processing, 2002 IEEE Workshop on. IEEE, 2002, pp. 428-431.
P. Walmsley, S. Godsill, and P. Rayner, Bayesian modelling of harmonic signals for polyphonic music tracking, Cambridge Music Processing Colloquium, Cambridge, UK, September, vol. 30, pp. 1-5, Nov. 1999. [Online]. Available: http://citeseer.ist.psu.edu/walmsley99bayesian.html.
P. Smaragdis and J. C. Brown, Non-negative matrix factorization for polyphonic music transcription, in Applications of Signal Processing to Audio and Acoustics, 2003 IEEE Workshop on. IEEE, 2003, pp. 177-180.
A. Klapuri, T. Virtanen, and J.-M. Holm, Robust multipitch estimation for the analysis and manipulation of polyphonic musical signals, in Proc. COST-G6 Conference on Digital Audio Effects, 2000, pp. 233-236.
K. D. Martin, A blackboard system for automatic transcription of simple polyphonic music, Massachusetts Institute of Technology Media Laboratory Perceptual Computing Section Technical Report, No. 385, 1996.
L. Rabiner and B.-H. Juang, Fundamentals of speech recognition, 1993.
P. R. Cook, Music, Cognition, and Computerized Sound: An Introduction to Psychoacoustsics. The MIT press, 2001.
S. Paris and C. Jauffret, Frequency line tracking using HMM-based schemes [passive sonar], Aerospace and Electronic Systems, IEEE Transactions on, vol. 39, No. 2, pp. 439-449, 2003.
W. Birmingham, B. Pardo, C. Meek, and J. Shifrin, The MusArt music-retrieval system, D-lib Magazine, vol. 8, No. 2, 2002.
M. P. Ryynanen and A. Klapuri, Polyphonic music transcription using note event modeling, in Applications of Signal Processing to Audio and Acoustics, 2005. IEEE Workshop on. IEEE, 2005, pp. 319-322.
S. A. Abdallah and M. D. Plumbley, Polyphonic music transcription by non-negative sparse coding of power spectra, in Proc. 5th Intl Conf. on Music Information Retrieval (ISMIR), 2004, pp. 10-14.

(56) References Cited

OTHER PUBLICATIONS

D. Seung and L. Lee, Algorithms for non-negative matrix factorization, Advances in neural information processing systems, vol. 13, pp. 556-562, 2001.
N. Degara, E. A. Rua, A. Pena, S. Torres-Guijarro, M. E. Davies, and M. D. Plumbley, Reliability-informed beat tracking of musical signals, Audio, Speech, and Language Processing, IEEE Transactions on, vol. 20, No. 1, pp. 290-301, 2012.
A. P. Klapuri, A perceptually motivated multiple-f0 estimation method, in Applications of Signal Processing to Audio and Acoustics, 2005. IEEE Workshop on. IEEE, 2005, pp. 291-294.
A. Brenzikofer, Instrument recognition and transcription in polyphonic music detection of saxophone melody in a jazz quartet recording, 2004.
J. C. Brown, Calculation of a constant Q spectral transform, The Journal of the Acoustical Society of America, vol. 89, p. 425, 1991.
C. L. Nikias and J. M. Mendel, Signal processing with higher-order spectra, Signal Processing Magazine, IEEE, vol. 10, No. 3, pp. 10-37, 1993.
P. Nesi, G. Pantaleo, and F. Argenti, Automatic transcription of polyphonic music based on constant-Q bispectral analysis for mirex 2009.
K. D. Martin, Automatic transcription of simple polyphonic music, in Presented at the Third Joint Meeting of the Acoustical Societies of America and Japan, 1996.
A. Klapuri et al., Automatic transcription of music, in Proceedings of the Stockholm Music Acoustics Conference. Citeseer, 1998, pp. 6-9.
R. Kelly, Automatic transcription of polyphonic music using a note masking technique, University of Limerick, 2010.
A. M. Barbancho, L. J. Tard'on, and I. Barbancho, Pic detector for piano chords, EURASIP Journal on Advances in Signal Processing, vol. 2010, p. 6, 2010.
G. Costantini, R. Perfetti, and M. Todisco, Event based transcription system for polyphonic piano music, Signal Processing, vol. 89, No. 9, pp. 1798-1811, 2009.
E. Benetos and S. Dixon, Polyphonic music transcription using note onset and offset detection, in Acoustics, Speech and Signal Processing (ICASSP), 2011 IEEE International Conference on, 2011, pp. 37-40.
M. Slaney and R. F. Lyon, A perceptual pitch detector, in Acoustics, Speech, and Signal Processing, 1990. ICASSP-90., 1990 International Conference on. IEEE, 1990, pp. 357-360.
F. Argenti, P. Nesi, and G. Pantaleo, Automatic transcription of polyphonic music based on the constant-q bispectral analysis, Audio, Speech, and Language Processing, IEEE Transactions on, vol. 19, No. 6, pp. 1610-1630, 2011.
A. Paradzinets, H. Harb, and L. Chen, Use of continuous wavelet-like transform in automated music transcription, Signal Processing Conference, 2006 14th European, 2006.
A. S. Bregman, Auditory scene analysis: The perceptual organization of sound. The MIT Press, 1994.
E. D. Scheirer, Tempo and beat analysis of acoustic musical signals, The Journal of the Acoustical Society of America, vol. 103, p. 588, 1998.
W. A. Schloss, On the automatic transcription of percussive music—from acoustic signal to high-level analysis, 1985.
E. Dunne and M. McConnell, Pianos and continued fractions, Mathematics Magazine, vol. 72, No. 2, pp. 104-115, 1999.
Patent Examination Report No. 1 for AU Patent Application No. 2014204540, dated Jun. 2, 2015.
Notice of Acceptance for AU Patent Application No. 2014204540, dated Aug. 7, 2015.

* cited by examiner

AUDIO SIGNAL PROCESSING METHODS AND SYSTEMS

PRIORITY CLAIM

This application claims the benefit under 35 U.S.C. §119 of Australian Complete Patent Application Serial No. 2014204540, filed Jul. 21, 2014, the contents of which are incorporated herein by this reference.

TECHNICAL FIELD

This application generally relates to audio signal processing methods and systems and, in particular, processing methods and systems of complex audio signals having multiple fundamental frequency components.

BACKGROUND

Signal processing is a tool that can be used to gather and display information about audio events. Information about the event may include the frequency of the audio event (i.e., the number of occurrences of a repeating event per unit time), its onset time, its duration and the source of each sound.

Developments in audio signal analysis have resulted in a variety of computer-based systems to process and analyze audio events generated by musical instruments or by human speech, or those occurring underwater as a result of natural or man-made activities. However, past audio signal processing systems have had difficulty analyzing sounds having certain qualities such as:

(A) multiple distinct fundamental frequencies components ("FFCs") in the frequency spectrum; and/or (B) one or more integral multiples, or harmonic components ("HCs"), of a fundamental frequency in the frequency spectrum.

Where an audio signal has multiple FFCs, this makes the processing of such signals difficult. The difficulties are heightened when HCs related to the multiple FFCs interfere with each other as well as the FFCs. In the past, systems analyzing multiple FFC signals have suffered from problems such as:

erroneous results and false frequency detections;

not handling sources with different spectra profiles or where FFC(s) of a sound is/are not significantly stronger in amplitude than associated HC(s);

and also, in the context of music audio signals particularly:

mischaracterizing the missing fundamental: where the pitch of an FFC is heard through its HC(s), even though the FFC itself is absent;

mischaracterizing the octave problem: where an FFC and its associated HC(s), or octaves, are unable to be separately identified; and spectral masking: where louder musical sounds mask other musical sounds from being heard.

Prior systems that have attempted to identify the FFCs of a signal based on the distance between zero crossing-points of the signal have been shown to inadequately deal with complex waveforms composed of multiple sine waves with differing periods. More sophisticated approaches have compared segments of a signal with other segments offset by a predetermined period to find a match: average magnitude difference function ("AMDF"), Average Squared Mean Difference Function ("ASMDF"), and similar autocorrelation algorithms work this way. While these algorithms can provide reasonably accurate results for highly periodic signals, they have false detection problems (e.g., "octave errors," referred to above), trouble with noisy signals, and may not handle signals having multiple simultaneous FFCs (and HCs).

Brief Description of Audio Signal Terminology

Before an audio event is processed, an audio signal representing the audio event (typically an electrical voltage) is generated. Audio signals are commonly a sinusoid (or sine wave), which is a mathematical curve having features including an amplitude (or signal strength), often represented by the symbol A (being the peak deviation of the curve from zero), a repeating structure having a frequency, f (being the number of complete cycles of the curve per unit time), and a phase, $\phi$ (which specifies where in its cycle the curve commences).

The sinusoid with a single resonant frequency is a rare example of a pure tone. However, in nature and music, complex tones generally prevail. These are combinations of various sinusoids with different amplitudes, frequencies and phases. Although not purely sinusoidal, complex tones often exhibit quasi-periodic characteristics in the time domain. Musical instruments that produce complex tones often achieve their sounds by plucking a string or by modal excitation in cylindrical tubes. In speech, a person with a "bass" or "deep" voice has lower range fundamental frequencies, while a person with a "high" or "shrill" voice has higher range fundamental frequencies. Likewise, an audio event occurring underwater can be classified depending on its FFCs.

A "harmonic" corresponds to an integer multiple of the fundamental frequency of a complex tone. The first harmonic is synonymous to the fundamental frequency of a complex tone. An "overtone" refers to any frequency higher than the fundamental frequency. The term "inharmonicity" refers to how much one quasi-periodic sinusoidal wave varies from an ideal harmonic.

Computer and Mathematical Terminology: The discrete Fourier transform ("DFT") converts a finite list of equally spaced samples of a function into a list of coefficients of a finite combination of complex sinusoids, which have those same sample values. By use of the DFT, and the inverse DFT, a time-domain representation of an audio signal can be converted into a frequency-domain representation. The fast Fourier transform ("FFT"), is a DFT algorithm that reduces the number of computations needed to perform the DFT and is generally regarded as an efficient tool to convert a time-domain signal into a frequency-domain signal.

DISCLOSURE

Provided are methods and systems of processing audio signals having multiple FFCs. More particularly, the disclosure can be used to identify the fundamental frequency content of an audio event containing a plurality of different FFCs (with overlapping harmonics). Further, the disclosure can, at least in some embodiments, enable the visual display of the FFCs (or known audio events corresponding to the FFCs) of an audio event and, at least in some embodiments, the disclosure is able to produce a transcription of the known audio events identified in an audio event.

One application hereof in the context of music audio processing is to accurately resolve the notes played in a polyphonic musical signal. "Polyphonic" is taken to mean music where two or more notes are produced at the same time. Although music audio processing is one application of the methods and systems of this disclosure as in music audio signal processing, it is to be understood that the benefits of the disclosure in providing improved processing of audio signals having multiple FFCs extend to signal processing fields such as sonar, phonetics (e.g., forensic phonetics, speech recognition), music information retrieval, speech coding, musical performance systems that categorize and manipulate music, and potentially any field that involves analysis of audio signals having FFCs.

Benefits to audio signal processing are many: apart from resulting in improved audio signal processing more generally, it can be useful in signal processing scenarios where background noise needs to be separated from discrete sound events, for example. In passive sonar applications, the disclosure can identify undersea sounds by their frequency and harmonic content. For example, the disclosure can be applied to distinguish underwater audio sounds from each other and from background ocean noise—such as matching a 13 hertz signal to a submarine's three bladed propeller turning at 4.33 revolutions per second.

In the context of music audio signal processing, music transcription by automated systems also has a variety of applications, including the production of sheet music, the exchange of musical knowledge and enhancement of music education. Similarly, song-matching systems can be improved by the disclosure, whereby a sample of music can be accurately processed and compared with a catalogue of stored songs in order to be matched with a particular song. A further application of the disclosure is in the context of speech audio signal processing, whereby the fundamental frequencies of multiple speakers can be distinguished and separated from background noise.

This disclosure is, to a substantial extent, aimed at alleviating or overcoming problems associated with existing signal processing methods and systems, including the inability to accurately process audio signals having multiple FFCs and associated HCs. Embodiments of the signal processes identifying the FFCs of audio signals is described below with reference to methods and systems of the disclosure.

Accordingly, provided is a novel approach to the processing of audio signals, particularly those signals having multiple FFCs. By employing the carefully designed operations set out below, the FFCs of numerous audio events occurring at the same time can be resolved with greater accuracy than existing systems.

While this disclosure is particularly well-suited to improvements in the processing of audio signals representing musical audio events, and is described in this context below for convenience, the disclosure is not limited to this application. The disclosure may also be used for processing audio signals deriving from human speech and/or other natural or machine-made audio events.

In a first aspect, there is provided a method of identifying one or more fundamental frequency component(s) ("MIFFC") of an audio signal, comprising:

(a) filtering the audio signal to produce a plurality of sub-band time domain signals;
(b) transforming a plurality of sub-band time domain signals into a plurality of sub-band frequency domain signals by mathematical operators;
(c) summing together a plurality of sub-band frequency domain signals to yield a single spectrum;
(d) calculating the bispectrum of a plurality of sub-band time domain signals;
(e) summing together the bispectra of a plurality of sub-band time domain signals;
(f) calculating the diagonal of a plurality of the summed bispectra (the diagonal bispectrum);
(g) multiplying the single spectrum and the diagonal bispectrum to produce a product spectrum; and
(h) identifying one or more fundamental frequency component(s) of the audio signal from the product spectrum or information contained in the product spectrum.

Preferably, as a precursor step, the MIFFC includes an audio event receiving step ("AERS") for receiving an audio event and converting the audio event into the audio signal. The AERS is for receiving the physical pressure waves constituting an audio event and, in at least one preferred embodiment, producing a corresponding digital audio signal in a computer-readable format such as a wave (.wav) or FLAC file. The AERS preferably incorporates an acoustic to electric transducer or sensor to convert the sound into an electrical signal. Preferably, the transducer is a microphone.

Preferably, the AERS enables the audio event to be converted into a time domain audio signal. The audio signal generated by the AERS is preferably able to be represented by a time domain signal (i.e., a function), which plots the amplitude, or strength, of the signal against time.

In step (g) of the MIFFC, the diagonal bispectrum is multiplied by the single spectrum from the filtering step to yield the product spectrum. The product spectrum contains information about FFCs present in the original audio signal input in step (a), including the dominant frequency peaks of the spectrum of the audio signal and the FFCs of the audio signal.

Preferably, one or more identifiable fundamental frequency component(s) is associated with a known audio event, so that identification of one or more fundamental frequency component(s) enables identification of one or more corresponding known audio event(s) present in the audio signal. In more detail, the known audio events are specific audio events that have characteristic frequency content that permits them to be identified by resolving the FFC(s) within a signal.

The MIFFC may comprise visually representing, on a screen or other display means, any or all of the following:

the product spectrum;
information contained in the product spectrum;
identifiable fundamental frequency components; and/or
a representation of identifiable known audio events in the audio signal.

In a preferred form of the disclosure, product spectrum includes a plurality of peaks and fundamental frequency component(s) of the audio signal identifiable from the locations of the peaks in the product spectrum.

In the filtering step (a), the filtering of the audio signal is preferably carried out using a constant-Q filterbank applying a constant ratio of frequency to bandwidth across frequencies of the audio signal. The filterbank is preferably structured to generate good frequency resolution at the cost of poorer time resolution at the lower frequencies, and good time resolution at the cost of poorer frequency resolution at high frequencies.

The filterbank preferably comprises a plurality of spectrum analyzers and a plurality of filter and decimate blocks, in order to selectively filter the audio signal. The constant-Q filterbank is described in greater depth in the Detailed Description below.

In steps (b) and (c), the audio signal is operated on by a transform function and summed to deliver an FFT single spectrum (called the single spectrum). Preferably, a Fourier transform is used to operate on the SBTDSs, and more preferably still, a Fast Fourier transform is used. However, other transforms may be including the Discrete Cosine Transform and the Discrete Wavelet Transform, and, alternatively, Mel Frequency Cepstrum Coefficients (based on a nonlinear mel scale) can also be used to represent the signal.

Step (d) of the MIFFC involves calculating the bispectrum for each sub-band of the multiple SBTDS. In step (e) the bispectra of each sub-band are summed to calculate a full bispectrum, in matrix form. In step (f) of the MIFFC, the diagonal of this matrix is taken, yielding a quasi-spectrum called the diagonal bispectrum. The usual mathematical approach to diagonalizing matrices is applied, whereby a square matrix is produced with elements on the main diagonal. Where the diagonal constant Q filterbank is applied, the result is called the constant-Q bispectrum (or DCQBS).

In a preferred form of the disclosure, the audio signal comprises a plurality of audio signal segments, and fundamental frequency components of the audio signal are identifiable from the plurality of corresponding product spectra produced for the plurality of segments, or from the information contained in the product spectra for the plurality of segments.

The audio signal input is preferably a single frame audio signal and, more preferably still, a single-frame time domain signal ("SFTDS"). The SFTDS is pre-processed to contain a time-discretized audio event (i.e., an extract of an audio event determined by an event onset and event offset time). The SFTDS can contain multiple FFCs. The SFTDS is preferably passed through a constant-Q filterbank to filter the signal into sub-bands, or multiple time-domain sub-band signals ("MTDSBS"). Preferably, the MIFFC is iteratively applied to each SFTDS. The MIFFC method can be applied to a plurality of single-frame time domain signals to determine the dominant frequency peaks and/or the FFCs of each SFTDS, and thereby, the FFCs within the entire audio signal can be determined.

The method in accordance with the first aspect of the disclosure is capable of operating on a complex audio signal and resolving information about FFCs in that signal. The information about the FFCs allows, possibly in conjunction with other signal analysis methods, the determination of additional information about an audio signal, for example, the notes played by multiple musical instruments, the pitches of spoken voices or the sources of natural or machine-made sounds.

Steps a) to h) and the other methods described above are preferably carried out using a general purpose device programmable to carry out a set of arithmetic or logical operations automatically, and the device can be, for example, a personal computer, laptop, tablet or mobile phone. The product spectrum and/or information contained in the product spectrum and/or the fundamental frequency components identified and/or the known audio events corresponding to the FFC(s) identified can be produced on a display means on such a device (e.g., a screen, or other visual display unit) and/or can be printed as, for example, sheet music.

Preferably, the audio event comprises a plurality of audio event segments, each being converted by the audio event receiving step into a plurality of audio signal segments, wherein fundamental frequency components of the audio event are identifiable from the plurality of corresponding product spectra produced for the plurality of audio signal segments, or from the information contained in the product spectra for the plurality of audio signal segments.

In accordance with a second aspect of the disclosure, there is provided the method in accordance with the first aspect of the disclosure, wherein the method further includes any one or more of:

(i) a signal discretization step;
(ii) a masking step; and/or
(iii) a transcription step.

The Signal Discretization Step ("SDS")

The SDS ensures the audio signal is discretized or partitioned into smaller parts able to be fed one at a time through the MIFFC, enabling more accurate frequency-related information about the complex audio signal to be resolved. As a result of the SDS, noise and spurious frequencies can be distinguished from fundamental frequency information present in the signal.

The SDS can be characterized in that a time domain audio signal is discretized into windows (or time-based segments of varying sizes). The energy of the audio signal is preferably used as a means to recognize the start and end time of a particular audio event. The SDS may apply an algorithm to assess the energy characteristics of the audio signal to determine the onset and end times for each discrete sound event in the audio signal. Other characteristics of the audio signal may be used by the SDS to recognize the start and end times of discrete sound events of a signal, such as changes in spectral energy distribution or changes in detected pitch.

Where an audio signal exhibits periodicity (i.e., a regular repeating structure) the window length is preferably determined having regard to this periodicity. If the form of an audio signal changes rapidly, then the window size is preferably smaller; whereas the window size is preferably larger if the form of the audio signal doesn't change much over time. In the context of music audio signals, window size is preferably determined by the beats per minute ("BPM") in the music audio signal; that is, smaller window sizes are used for higher BPMs and larger windows are used for lower BPMs.

Preferably, the AERS and SDS are used in conjunction with the MIFFC so that the MIFFC is permitted to analyze a discretized audio signal of a received audio event.

The Masking Step ("MS")

The masking step preferably applies a quantizing algorithm and a mask bank consisting of a plurality of masks.

After the mask bank is created, the audio signal to be processed by the MIFFC is able to be quantized and masked. The MS operates to sequentially resolve the underlying multiple FFCs of an audio signal. The MS preferably acts to check and refine the work of the MIFFC by removing from the audio signal, in an iterative fashion, the frequency content associated with known audio events, in order to resolve the true FFCs contained within the audio signal (and thereby the original audio event).

Mask Bank

The mask bank is formed by calculating the diagonal bispectrum (and, hence, the FFCs) by application of the MIFFC to known audio events. The FFC(s) associated with the known audio events preferably determine the frequency spectra of the masks, which are then separately recorded and stored to create the mask bank. In a preferred form of the disclosure, the full range of known audio events are input into the MIFFC so that corresponding masks are generated for each known audio event.

The masks are preferably specific to the type of audio event to be processed; that is, known audio events are used as masks, and these known audio events are preferably clear and distinct. The known audio events to be used as masks are preferably produced in the same environment as the audio event that is to be processed by the MIFFC.

Preferably, the fundamental frequency spectra of each unique mask in the mask bank is set in accordance with the fundamental frequency component(s) resulting from application of the MIFFC to each unique known audio event. In the context of a musical audio signal, the number of masks may correspond to the number of possible notes the instrument(s) can produce. Returning to the example where a musical instrument (a piano) is the audio source, since there are 88 possible piano notes, there are 88 masks in a mask bank for resolving piano-based audio signals.

The number of masks stored in the algorithm is preferably the total number of known audio events into which an audio signal may practically be divided, or some subset of these known audio events chosen by the user. Preferably, each mask in the mask bank contains fundamental frequency spectra associated with a known audio event.

Thresholding

In setting up the mask bank, the product spectrum is used as input, the input is preferably "thresholded" so that audio signals having a product spectrum amplitude less than a threshold amplitude are floored to zero. Preferably, the threshold amplitude of the audio signal is chosen to be a fraction of the maximum amplitude, such as 0.1× (maximum product spectrum amplitude). Since fundamental frequency amplitudes are typically above this level, this minimizes the amount of spurious frequency content in the method or system. The same applies during the iterative masking process.

Quantizing Algorithm

After thresholding, a "quantizing" algorithm can be applied. Preferably, the quantizing algorithm operates to map the frequency spectra of the product spectrum to a series of audio event-specific frequency ranges, the mapped frequency spectra together constituting an array. Preferably, the algorithm maps the frequency axis of the product spectrum (containing peaks at the fundamental frequencies of the signal) to audio event-specific frequency ranges. It is here restated that the product spectrum is the diagonal bispectrum multiplied by the single spectrum, each spectrum being obtained from the MIFFC.

As an example of mapping to an audio event-specific frequency range, the product spectrum frequency of an audio signal from a piano may be mapped to frequency ranges corresponding to individual piano notes (e.g., middle C, or C4 could be attributed the frequency range of 261.626 Hz± a negligible error; and treble C, or C5, attributed the range of 523.25± a negligible error).

In another example, a particular high frequency fundamental signal from an underwater sound source is attributable to a particular source, whereas a particular low fundamental frequency signal is attributable to a different source.

Preferably, the quantizing algorithm operates iteratively and resolves the FFCs of the audio signal in an orderly fashion, for example, starting with lower frequencies before moving to higher frequencies, once the lower frequencies have been resolved.

Masking

The masking process works by subtracting the spectral content of one or more of the masks from the quantized signal.

Preferably, the one or more masks applied to the particular quantized signal are those that correspond to the fundamental frequencies identified by the product spectrum. Alternatively, a larger range of masks, or some otherwise predetermined selection of masks, can be applied.

Preferably, iterative application of the masking step comprises applying the lowest applicable fundamental frequency spectra mask in the mask bank, then successively higher fundamental frequency spectra masks until the highest fundamental frequency spectra mask in the mask bank is applied. The benefits of this approach is that it minimizes the likelihood of subtracting higher frequency spectra associated with lower FFCs, thereby improving the chances of recovering the higher FFCs.

Alternatively, correlation between an existing mask and the input signal may be used to determine if the information in the signal matches a particular FFC or set of FFC(s). In more detail, iterative application of the masking step comprises performing cross-correlation between the diagonal of the summed bispectra of the method as claimed in step (f) of the MIFFC and masks in the mask bank, then selecting the mask having the highest cross-correlation value. The high correlation mask is then subtracted from the array, and this process continues iteratively until no frequency content below a minimum threshold remains in the array. This correlation method can be used to overcome musical signal processing problems associated with the missing fundamental (where a note is played but its fundamental frequency is absent, or significantly lower in amplitude than its associated harmonics).

Preferably, the masks are applied iteratively to the quantized signal, so that after each mask has been applied, an increasing amount of spectral content of the signal is removed. In the final iteration, there is preferably zero amplitude remaining in the signal, and all of the known audio events in the signal have been resolved. The result is an array of data that identifies all of the known audio events (e.g., notes) that occur in a specific signal.

It is preferred that the mask bank operates by applying one or more masks to the array such that the frequency spectra of one or more masks is subtracted from the array, in an iterative fashion, until there is no frequency spectra left in the array below a minimum signal amplitude threshold. Preferably, the one or more masks to be applied are chosen based on which fundamental frequency component(s) are identifiable in the product spectrum of the audio signal.

Preferably, the masking step comprises producing a final array identifying each of the known audio events present in the audio signal, wherein the known audio events identifiable in the final array are determinable by observing which of the masks in the masking step are applied.

It is to be understood that the masking step is not necessary to identify the known audio events in an audio event because they can be resolved from product spectra alone. In both polyphonic mask building and polyphonic music transcription, the masking step is of greater importance for higher polyphony audio events (where numerous FFCs are present in the signal).

The Transcription Step (TS)

The TS is for converting the output of the MS (an array of data that identifies known audio events present in the audio signal) into a transcription of the audio signal. Preferably, the transcription step requires only the output of the MS to transcribe the audio signal. Preferably, the transcription step comprises converting the known audio events identifiable by the masking step into a visually represented transcription of the identifiable known audio events.

In a preferred form of the disclosure, the transcription step comprises converting the known audio events identifiable by the product spectrum into a visually representable transcription of the identifiable known audio events.

In a further preferred form of the disclosure, the transcription step comprises converting the known audio events identifiable by both the masking step and the product spectrum into a visually representable transcription of the identified known audio events.

Preferably, the transcription comprises a set number of visual elements. It is preferable that the visual elements are those commonly used in transcription of audio. For example, in the context of music transcription, the TS is preferably able to transcribe a series of notes on staves, using the usual convention of music notation.

Preferably, the TS employs algorithms or other means for conversion of an array to a format-specific computer-readable file (e.g., a MIDI file). Preferably, the TS then uses an algorithm or other means to convert a format-specific computer-readable file into a visual representation of the audio signal (e.g., sheet music or display on a computer screen).

It will be readily apparent to a person skilled in the art that a method that incorporates an AERS, an SDS, an MIFFC, an MS and a TS is able to convert an audio event or audio events into an audio signal, then identify the FFCs of the audio signal (and thereby identify the known audio events present in the signal); then the method is able to visually display the known audio events identified in the signal (and the timing of such events). It should also be readily apparent that the audio signal may be broken up by the SDS into single-frame time domain signals ("SFTDS"), which are each separately fed into the MIFFC and MS, and the arrays for each SFTDS are able to be combined by the TS to present a complete visual display of the known audio events in the entire audio signal.

In a particularly preferred form of the disclosure, there is provided a computer-implementable method that includes the AERS, the SDS, the MIFFC, the MS and the TS of the disclosure, whereby the AERS converts a music audio event into a time domain signal or TDS, the SDS separates the TDS into a series of time-based windows, each containing discrete segments of the music audio signal (SFTDS), the MIFFC and MS operate on each SFTDS to identify an array of notes present in the signal, wherein the array contains information about the received audio event including, but not limited to, the onset/offset times of the notes in the music received and the MIDI numbers corresponding to the notes received. Preferably, the TS transcribes the MIDI file generated by the MS as sheet music.

It is contemplated that any of the above-described features of the first aspect of the disclosure may be combined with any of the above-described features of the second aspect of the disclosure.

According to a third aspect of the disclosure, there is provided a system for identifying the fundamental frequency component(s) of an audio signal or audio event, wherein the system includes at least one numerical calculating apparatus or computer, wherein the numerical calculating apparatus or computer is configured for performing any or all of the AERS, SDS, MIFFC, MS and/or TS described above, including the calculation of the single spectrum, the diagonal spectrum, the product spectrum, the array and/or transcription of the audio signal.

According to a fourth aspect of the disclosure, there is computer-readable medium for identifying the fundamental frequency component(s) of an audio signal or audio event comprising code components configured to enable a computer to carry out any or all of the AERS, SDS, MIFFC, MS and/or the TS including the calculation of the single spectrum, the diagonal spectrum, the product spectrum, the array and/or transcription of the audio signal.

Further preferred features and advantages of the disclosure will be apparent to those skilled in the art from the following description of preferred embodiments of the disclosure.

BRIEF DESCRIPTION OF THE DRAWINGS

Possible and preferred features of this disclosure will now be described with particular reference to preferred embodiments of the disclosure in the accompanying drawings. However, it is to be understood that the features illustrated in and described with reference to the drawings are not to be construed as limiting on the scope of the disclosure. In the drawings.

DETAILED DESCRIPTION

In relation to the applications and embodiments of the disclosure described herein, while the descriptions may, at times, present the methods and systems of the disclosure in a practical or working context, the disclosure is intended to be understood as providing the framework for the relevant steps and actions to be carried out, but not limited to scenarios where the methods are being carried out. More definitively, the disclosure may relate to the framework or structures necessary for improved signal processing, not limited to systems or instances where that improved processing is actually carried out.

Figure 1:
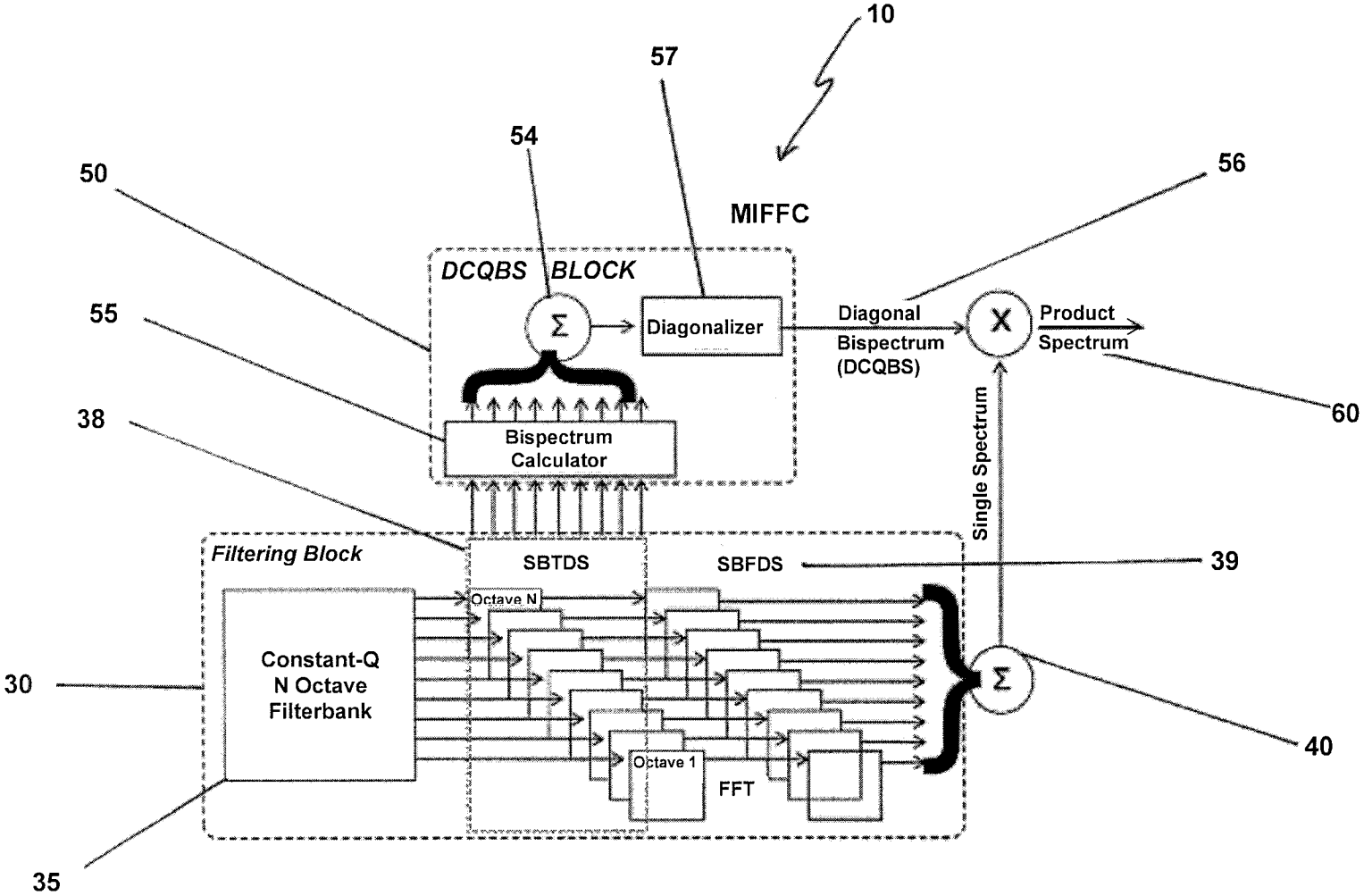
FIG. 1 illustrates a preferred method for identifying fundamental frequency component(s), or MIFFC, embodying this disclosure.

Referring to FIG. 1, there is depicted a method for identifying fundamental frequency component(s) 10, or MIFFC, for resolving the FFCs of a single time-domain frame of a complex audio signal, represented by the function $x_p[n]$ and also called a single-frame time domain signal ("SFTDS"). The MIFFC 10 comprises a filtering block 30, a DCQBS block 50, then a multiplication of the outputs of each of these blocks, yielding a product spectrum 60, which contains information about FFCs present in the original SFTDS input.

Filtering Block

First, a function representing an SFTDS is received as input into the filtering block 30 of the MIFFC 10. The SFTDS is pre-processed to contain that part of the signal occurring between a pre-determined onset and offset time. The SFTDS passes through a constant-Q filterbank 35 to produce multiple sub-band time-domain signals ("SBTDSs") 38.

The Constant-Q Filterbank

The constant-Q applies a constant ratio of frequency to bandwidth (or resolution), represented by the letter Q, and is structured to generate good frequency resolution at the cost of poorer time resolution at the lower frequencies, and good time resolution at the cost of poorer frequency resolution at high frequencies.

This choice is made because the frequency spacing between two human ear-distinguishable sound events may only be in the order of 1 or 2 Hz for lower frequency events; however, in the higher ranges, frequency spacing between adjacent human ear-distinguishable events is in the order of thousands of Hz. This means frequency resolution is not as important at higher frequencies as it is at low frequencies for humans. Furthermore, the human ear is most sensitive to sounds in the 3-4 kHz channel so a large proportion of sound events that the human ear is trained to distinguish occur in this region of the frequency spectrum.

In the context of musical sounds, since the notes of melodies typically have notes of shorter duration than harmony or bass voices, it is logical to dedicate temporal resolution to higher frequencies. The above explains why a constant-Q filterbank is chosen; it also explains why such a filterbank is suitable in the context of analyzing music audio signals.

Figure 1A:
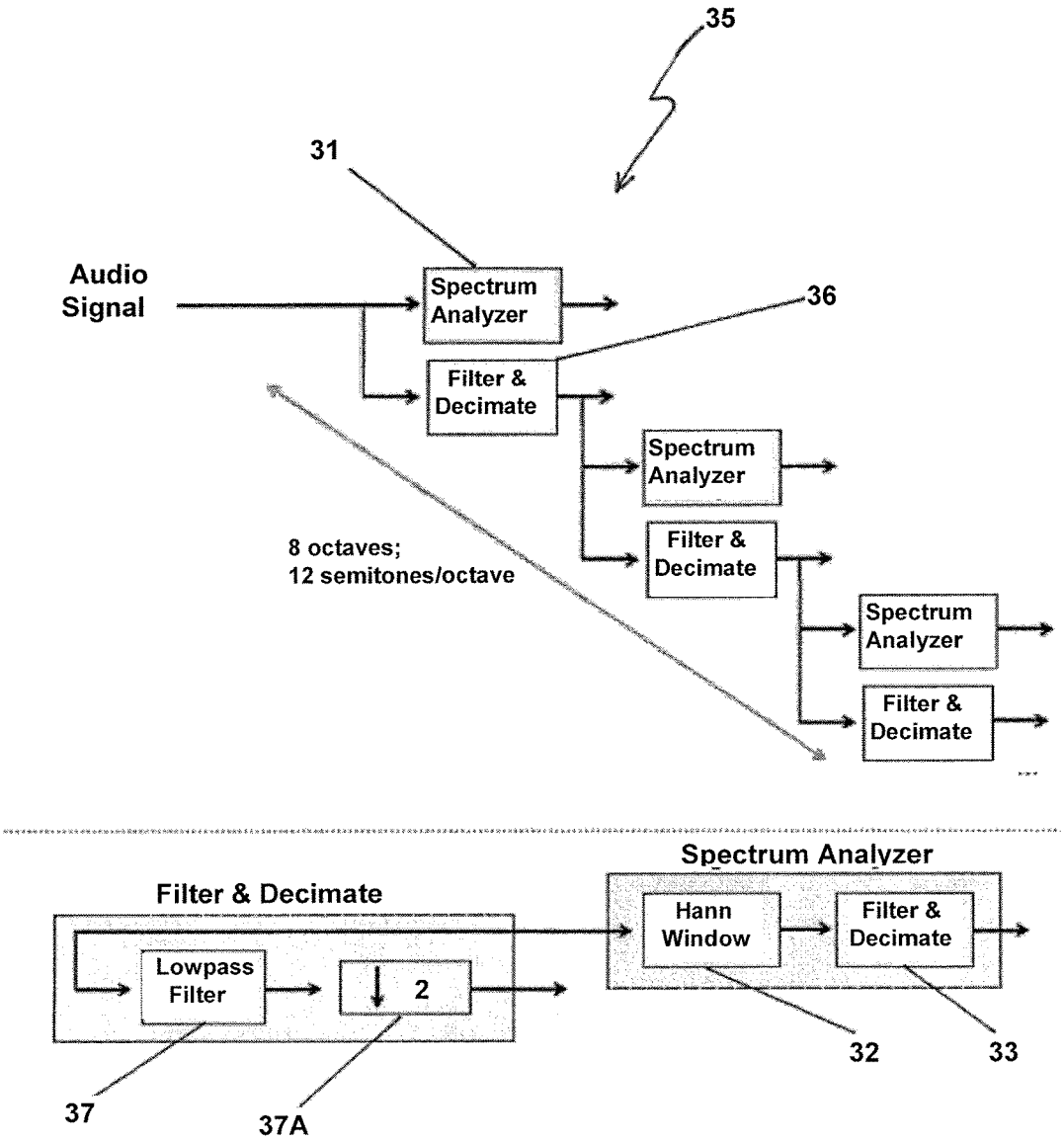
FIG. 1A illustrates a filterbank including a series of spectrum analyzers and filter and decimate blocks.

With reference to FIG. 1A, the filterbank 35 is composed of a series of spectrum analyzers 31 and filter and decimate blocks 36 (one of each are labelled in FIG. 1A), in order to selectively filter the audio signal 4. Inside each spectrum analyzer block 31, there is preferably a Hanning window sub-block 32 having a length related to onset and offset times of the SFTDS.

Specifically, the length of each frame is measured in sample numbers of digital audio data, which correspond to duration (in seconds). The actual sample number depends on the sampling rate of the generated audio signal; a sample rate of 11 kHz is taken. This means that 11,000 samples of audio data per second are generated. If the onset of the sound is at 1 second and the offset is at 2 seconds, this would mean that the onset sample number is 11,000 and the offset sample number is 22,000. Alternatives to Hanning windows include Gaussian and Hamming windows. Inside each spectrum analyzer block 31 is a fast Fourier transform sub-block 33. Alternative Transforms that may be used include Discrete Cosine Transforms and Discrete Wavelet Transforms, which may be suitable depending on the purpose and objectives of the analysis.

Inside each filter and decimate block 36, there is an anti-aliasing low-pass filter sub-block 37 and a decimation sub-block 37A. The pairs of spectrum analyzer and filter and decimate blocks 31 and 36 work to selectively filter the audio signal 4 into pre-determined frequency channels. At the lowest channel filter of the filterbank 35, good quality frequency resolution is achieved at the cost of poor time resolution. While the center frequencies of the filter sub-blocks change, the bandwidth is preserved across each pre-determined frequency channel, resulting in a constant-Q filterbank 35.

The numbers of pairs of spectrum analyzer and filter and decimate blocks 31 and 36 can be chosen depending on the frequency characteristics of the input signal. For example, when analyzing the frequency of audio signals from piano music, since the piano has eight octaves, eight pairs of these blocks can be used.

The following equations derive the constant-Q transform. Bearing close relation to the Fourier transform, the constant-Q transform ("CQT") contains a bank of filters, however, in contrast, it has geometrically spaced center frequencies:

$$f_i = f_o \cdot 2^{i/b}$$

for $i \in Z$, where b indicates the number of filters per octave. The bandwidth of the kth filter is chosen so as to preserve the octave relationship with the adjacent Fourier domain:

$$BW_i = f_{i+1} - f_i = f_i\left(2^{\frac{1}{b}} - 1\right)$$

In other words the transform can be thought of as a series of logarithmically spaced filters, with the kth filter having a spectral width some multiple of the previous filter's width. This produces a constant ratio of frequency:bandwidth (resolution), whereby $$Q = \frac{f_i}{BW_i} = \left(2^{\frac{1}{b}} - 1\right)^{-1}$$

where $f_i$ is the center frequency of the ith band filter and $BW_i$ is the corresponding bandwidth. In Constant-Q filters, $Q_i = Q$, where $i \in \mathbb{Z}$ Q is constant and the bandwidth is preserved across each octave. From the above, the constant-Q transform may be derived as $$x^{cq}[k] := \frac{1}{N_k} \sum_{n=0}^{N_k} x[n] w_{N_k}[n] e^{\frac{-2\pi j Q n}{N_k}}$$

Where $N_k$ is the window length, $w_{Nk}$ is the windowing function, which is a function of window length, and the digital frequency is $2\pi Q/N_k$. This constant-Q transform is applied in the diagonal bispectrum (or DCQBS) block described below.

For a music signal context, in equation for Q above, by tweaking $f_i$ and b, it is possible to match note frequencies. Since there are 12 semitones (increments in frequency) in one octave, this can be achieved by choosing b=12 and $f_i$ corresponding to the center frequency of each filter. This can be helpful later in frequency analysis because the signals are already segmented into audio event ranges, so less spurious FFC note information is present. Different values for $f_i$ and b can be chosen so that the filterbank 35 is suited to the frequency structure of the input source. The total number of filters is represented by N.

Returning to FIG. 1, after passing through the filterbank 35, the single audio frame input is filtered into N sub-band time domain signals 38. Each SBTDS is acted on by an FFT function in the spectrum analyzer blocks 31 to produce N sub-band frequency domain signals 39 (or SBFDS), which are then summed to deliver a constant-Q FFT single spectrum 40, being the single spectrum of the SFTDS that was originally input into the filtering block 30.

In summary, the filtering block 30 produces two outputs: an FFT single spectrum 40 and N SBTDS 38. The user may specify the number of channels, b, being used so as to allow a trade-off between computational expense and frequency resolution in the constant-Q spectrum.

DCQBS Block

The DCQBS block 50 receives the N SBTDSs 38 as inputs and the bispectrum calculator 55 individually calculates the bispectrum for each. The bispectrum is described in detail below. Let an audio signal be defined by:

x[k] where $k \in \mathbb{Z}$ k is the sample number, where k is an integer (e.g., x[1], . . . , x[22,000]).

The magnitude spectrum of a signal is defined as the first order spectrum, produced by the discrete Fourier transform:

$$X(\omega) = \sum_{k=-\infty}^{\infty} x[k] e^{-j\omega k}$$

The power spectral density (PSD) of a signal is defined as the second order spectrum:

$$PSD_x(\omega)=X(\omega)X^*(\omega)$$

The bispectrum, B, is defined as the third order spectrum:

$$B_x[\omega_1,\omega_2]=X(\omega_1)X(\omega_2)X^*(\omega_1+\omega_2)$$

After calculating the bispectrum for each N time-domain sub-band signal, the N bispectra are then summed to calculate a full, constant-Q bispectrum 54. Mathematically, the full constant-Q bispectrum 54 is a symmetric, complex-valued non-negative, positive-semi-definite matrix. Another name for this type of matrix is a diagonally dominant matrix. The mathematical diagonal of this matrix is taken by the diagonalizer 57, yielding a quasi-spectrum called the diagonal bispectrum 56. The benefit of taking the diagonal is two-fold: first, it is faster to compute than the full Constant-Q bispectrum due to having substantially less data points (more specifically, for an M×M matrix, $M^2$ points are required, whereas, its diagonal contains only M points, effectively square-rooting the number of required calculations). More importantly, the diagonal bispectrum 56 yields peaks at the fundamental frequencies of each input signal. In more detail, the diagonal constant-Q bispectrum 56 contains information pertaining to all frequencies, with constant bandwidth to frequency ratio, and it removes a great deal of harmonic content from the signal information while boosting the fundamental frequency amplitudes (after multiplication with the single spectrum), which permits a more accurate reading of the fundamental frequencies in a given signal.

The output of the diagonalizer 57, the diagonal bispectrum 56, is then multiplied by the single spectrum 40 from the filtering block 30 to yield the product spectrum 60 as an output.

Mathematics of the Product Spectrum

The product spectrum 60 is the result of multiplying the single spectrum 40 with the diagonal bispectrum 56 of the SFTDS 20. It is described by recalling the bispectrum as:

$$B_x[\omega_1,\omega_2]=X(\omega_1)X(\omega_2)X^*(\omega_1+\omega_2)$$

The diagonal constant-Q bispectrum is given by applying a constant-Q transform (see above) to the bispectrum, then taking the diagonal:

$$B_{X_{CQ}}[\omega_1,\omega_2]=X_{CQ}(\omega_1)X_{CQ}(\omega_2)X^*_{CQ}(\omega_1+\omega_2)$$

$$\text{Diagonal Constant-}Q\text{ Bispectrum:}diag(B_{X_{CQ}}[\omega_1, w\omega_2])=diag(X_{CQ}(\omega_1)X_{CQ}(\omega_2)X^*_{CQ}(\omega_1+\omega_2))$$

Now, by multiplying the result with the single constant-Q spectrum, the product spectrum is yielded:

$$diag(B_{X_{CQ}}[\omega_1,\omega_2])=diag(X_{CQ}(\omega_1)X_{CQ}(\omega_2)X^*_{CQ}(\omega_1+\omega_2)\times X_{CQ}(\omega))$$

The product spectrum 60 contains information about FFCs present in the original SFTDS, and this will be described below with reference to an application.

Application

Figure 1B:
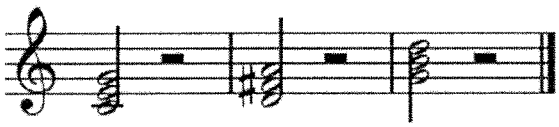
FIG. 1B illustrates three major triad chords—C4 major triad, D4 major triad and G4 major triad.

This application describes the MIFFC 10 used to resolve the fundamental frequencies of known audio event constituting notes played on a piano, also with reference to FIG. 1. In this example, the audio signal 4 comprises three chords on the piano are played one after the other: C4 major triad (notes C, E, G, beginning with C in the $4^{th}$ octave), D4 major triad (notes D, F#, A beginning with D in the $4^{th}$ octave), and G4 major triad (notes G, B, D beginning with G in the $4^{th}$ octave). This corresponds to the sheet music notation in FIG. 1B.

Each of the chords is discretized in pre-processing so that the audio signal 4 representing these notes is constituted by three SFTDSs, $x_1$ [n], $x_2$[n] and $x_3$[n], which are consecutively inserted into the filtering block 30. The length of each of the three SFTFDs is the same, and is determined by the length of time that each chord is played. Since the range of notes played is spread over two octaves, 16 channels are chosen for the filterbank 35. The first chord, whose SFTDS is represented by $x_1$[n], passes through the filterbank 35 to produce 16-time sub-band domain signals (SBTDS), $x_1$[k] (k: 1, 2 . . . 16). Similarly, 16 SBTDSs are resolved for each of $x_2$[k] and $x_3$[k].

The filtering block 30 also applies an FFT to each of the 16 SBTDSs for $x_1$[k], $x_2$[k] and $x_3$[k], to produce 16 sub-band frequency domain signals (SBFDSs) 38 for each of the chords. These sets of 16 SBFTSs are then summed together to form the single spectrum 40 for each of the chords; the single spectra are here identified as $SS_1$, $SS_2$, and $SS_3$.

The other output of the filtering block 30 is the 16 sub-band time-domain signals 38 for each of $x_1$[k], $x_2$[k] and $x_3$[k], which are sequentially input into the DCQBS block 50. In the DCQBS block 50 of the MIFFC 10 in this application of the disclosure, the bispectrum of each of the SBTDSs for the first chord is calculated, summed and then the resulting matrix is diagonalized to produce the diagonal constant-Q bispectrum 56; then the same process is undertaken for the second and third chords. These three diagonal constant-Q bispectra 56 are represented here by $DB_1$, $DB_2$ and $DB_3$.

The diagonal constant-Q bispectra 56 for each of the chords are then multiplied with their corresponding single spectra 40 (i.e., $DB_1 \times SS_1$; $DB_2 \times SS_2$; and $DB_1 \times SS_1$) to produce the product spectra 60 for each chord: $PS_3$, $PS_3$, and $PS_3$. The fundamental frequencies of each of the notes in the known audio event constituting the C4 major triad chord, C (~262 Hz), E (~329 Hz) and G (~392 Hz), are each clearly identifiable from the product spectrum 60 for the first chord from three frequency peaks in the product spectrum 60 localized at or around 262 Hz, 329 Hz, and 392 Hz. The fundamental frequencies for each of the notes in the known audio event constituting the D4 major triad chord and the known audio event constituting the G4 major triad chord are similarly resolvable from $PS_2$ and $PS_3$, respectively, based on the location of the frequency peaks in each respective product spectrum 60.

Other Applications

Just as the MIFFC 10 resolves information about the FFCs of a given musical signal, it is equally able to resolve information about the FFCs of other audio signals such as underwater sounds. Instead of a 16-channel filterbank (which was dependent on the two octaves over which piano music signal ranged in the first application), a filterbank 35 with a smaller or larger number of channels would be chosen to capture the range of frequencies in an underwater context. For example, the MIFFC 10 would preferably have a large number of channels if it were to distinguish between each of the following:

(i) background noise of a very low frequency (e.g., resulting from underwater drilling);

(ii) sounds emitted by a first category of sea-creatures (e.g., dolphins, whose vocalizations are said to range from ~1 kHz to ~200 kHz); and (iii) sounds emitted by a second category of sea-creatures (e.g., whales, whose vocalizations are said to range from ~10 Hz to ~30 kHz).

In a related application, the MIFFC 10 could also be applied so as to investigate the FFCs of sounds emitted by creatures, underwater, on land or in the air, which may be useful in the context of geo-locating these creatures, or more generally, in analysis of the signal characteristics of sounds emitted by creatures, especially in situations where there are multiple sound sources and/or sounds having multiple FFCs.

Similarly, the MIFFC 10 can be used to identify FFCs of vocal audio signals in situations where multiple persons are speaking simultaneously, for example, where signals from a first person with a high pitch voice may interfere with signals from a second person with a low pitch voice. Improved resolution of FFCs of vocal audio signals has application in hearing aids, and, in particular, the cochlear implant, to enhance hearing. In one particular application of the disclosure, the signal analysis of a hearing aid can be improved to assist a hearing impaired person achieve something approximating the "cocktail party effect" (when that person would not otherwise be able to do so). The "cocktail party effect" refers to the phenomenon of a listener being able to focus his or her auditory attention on a particular stimulus while filtering out a range of other stimuli, much the same way that a partygoer can focus on a single conversation in a noisy room. In this situation, by resolving the fundamental frequency components of differently pitched speakers in a room, the MIFFC can assist in a hearing impaired person's capacity to distinguish one speaker from another.

Figure 2:
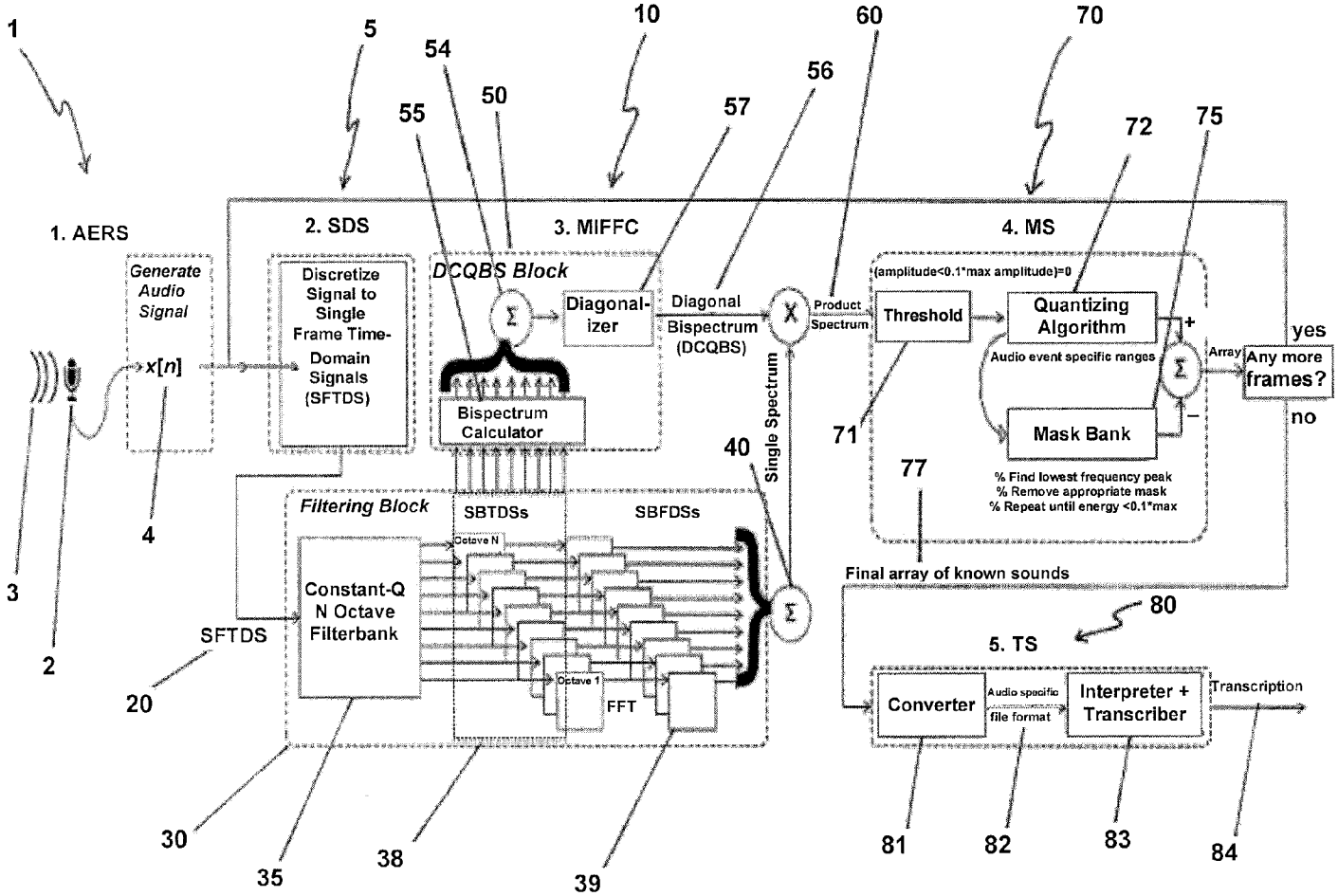
FIG. 2 illustrates a preferred method embodying this disclosure including an AERS, SDS, MIFFC, MS and TS.

A second embodiment of the disclosure is illustrated in FIG. 2, which depicts a five-step method 100 including an audio event receiving step (AERS) 1, a signal discretization step (SDS) 5, a method for identifying fundamental frequency component(s) (MIFFC) 10, a masking step (MS) 70, and a transcription step (TS) 80.

Audio Event Receiving Step ("AERS")

The AERS 1 is preferably implemented by a microphone 2 for recording an audio event 3. The audio signal x[n] 4 is generated with a sampling frequency and resolution according to the quality of the signal.

Signal Discretization Step (SDS)

The SDS 5 discretizes the audio signal 4 into time-based windows. The SDS 5 discretizes the audio signal 4 by comparing the energy characteristics (the Note Average Energy approach) of the signal 4 to make a series of SFTDSs 20. The SDS 5 resolves the onset and offset times for each discretizable segment of the audio event 3. The SDS 5 determines the window length of each SFTDS 20 by reference to periodicity in the signal so that rapidly changing signals preferably have smaller window sizes and slowly changing signals have larger windows.

Method for Identifying the Fundamental Frequency Component(s) ("MIFFC")

The MIFFC 10 of the second embodiment of the disclosure contains a constant-Q filterbank 35 as described in relation to the first embodiment. The MIFFC 10 of the second embodiment is further capable of performing the same actions as the MIFFC 10 in the first embodiment; that is, it has a filtering block 30 and a DCQBS block 50, which (collectively) are able to resolve multiple SBTDSs 38 from each SFTDS 20; apply fast Fourier transforms to create an equivalent SBFDS 39 for each SBTDS 38; sum together the SBFDSs 39 to form the single spectrum 40 for each SFTDS 20; calculate the bispectrum for each of the SBTDS 38 and then sum these bispectra together and diagonalize the result to form the diagonal bispectrum 56 for each SFTDS 20; and multiply the single spectrum 40 with the diagonal bispectrum 56 to produce the product spectrum 60 for each single frame of the audio fed through the MIFFC 10. FFCs (which can be associated with known audio events) of each SFTDS 20 are then identifiable from the product spectra produced.

Masking Step ("MS")

The MS 70 applies a plurality (e.g., 88) of masks to sequentially resolve the presence of known audio events (e.g., notes) in the audio signal 4, one SFTFS 20 at a time. The MS 70 has masks that are made to be specific to the audio event 3 to be analyzed. The masks are made in the same acoustic environment (i.e., having the same echo, noise, and other acoustic dynamics) as that of the audio event 3 to be analyzed. The same audio source that is to be analyzed is used to produce the known audio events forming the masks and the full range of known audio events able to be produced by that audio source are captured by the masks. The MS 70 acts to check and refine the work of the MIFFC 10 to more accurately resolve the known audio events in the audio signal 4. The MS 70 operates in an iterative fashion to remove the frequency content associated with known audio events (each corresponding to a mask) in order to determine which known audio events are present in the audio signal 4.

The MS 70 is set up by first creating a mask bank 75, after which the MS 70 is permitted to operate on the audio signal 4. The mask bank 75 is formed by separately recording, storing and calculating the diagonal bispectrum (DCQBS) 56 for each known audio event that is expected to be present in the audio signal 4 and using these as masks. The number of masks stored is the total number of known audio events that are expected to be present in the audio signal 4 under analysis. The masks applied to the audio signal 4 correspond to the masks associated with the fundamental frequencies indicated to be present in that audio signal 4 by the product spectrum 60 produced by the MIFFC 10, in accordance with the first embodiment of the disclosure described above.

The mask bank 75 and the process of its application to the audio signal 4 use the product spectrum 60 as input audio signal 4. The MS 70 applies a threshold 71 to the signal so that discrete signals having a product spectrum amplitude less than the threshold amplitude are floored to zero. The threshold amplitude is chosen to be a fraction (one tenth) of the maximum amplitude of the audio signal 4.

The MS 70 includes a quantizing algorithm 72 that maps the frequency axis of the product spectrum 60 to audio event-specific ranges. It starts by quantizing the lower frequencies before moving to the higher frequencies. The quantizing algorithm 72 iterates over each SFTDS 20 and resolves the audio event-specific ranges present in the audio signal 4. Then the mask bank 75 is applied, whereby masks are subtracted from the output of the quantizing algorithm 72 for each fundamental frequency indicated as present in the product spectrum 60 of the MIFFC 10. By iterative application of the MS 70, when there is no substantive amplitude remaining in the signal operated on by the MS 70, the SFTDS 20 is completely resolved (and, this is done until all SFTDSs 20 of the audio signal 4 have passed through the MS 70). The result is that, based on the masks applied to fully account for the spectral content of the audio signal 4, an array 76 of known audio events (or notes) associated with the masks is produced by the MS 70. This process continues until the final array 77 associated with all SFTDSs 20 has been produced. The final array 77 of data thereby indicates which known audio events (e.g., notes) are present in the entire audio signal 4. The final array 77 is used to check that the known audio events (notes) identified by the MIFFC 10 were correctly identified.

Transcription Step ("TS")

The TS 80 includes a converter 81 for converting the final array 77 of the MS 70 into a file format 82 that is specific to the audio event 3. In the case of musical audio events, such a file form is the MIDI file. Then, the TS 80 uses an interpreter/transcriber 83 to read the MIDI file and then transcribe the audio event 3. The output transcription 84 comprises a visual representation of each known audio event identified (e.g., notes on a music staff).

Each of the AERS 1, SDS 5, MIFFC 10, MS 70 and TS 80 in the second embodiment are realized by a written computer program that can be performed by a computer. In the case of the AERS 1, an appropriate audio event receiving and transducing device is connected to or inbuilt in a computer that is to carry out the AERS 1. The written program contains step by step instructions as to the logical and mathematical operations to be performed by the SDS 5, MIFFC 10, MS 70 and TS 80 on the audio signal 4 generated by the AERS 1 that represents the audio event 3.

Application

This application of the disclosure, with reference to FIG. 2, is a five-step method for converting a 10-second piece of random polyphonic notes played on a piano into sheet music. The method involves polyphonic mask building and polyphonic music transcription.

The first step is the AERS 1, which uses a low-impedance microphone with neutral frequency response setting (suited to the broad frequency range of the piano) to transduce the audio events 3 (piano music) into an electrical signal. The sound from the piano is received using a sampling frequency of 12 kHz (well above the highest frequency note of the $88^{th}$ key on a piano, C8, having ~4186 Hz), with 16-bit resolution. These numbers are chosen to minimize computation but deliver sufficient performance.

The audio signal 4 corresponding to the received random polyphonic piano notes is discretized into a series of SFTDSs 20. This is the second step of the method illustrated in FIG. 2. The Note Average Energy discretization approach is used to determine the length of each SFTDS 20. The signal is discretized (i.e., all the onset and offset times for the notes have been detected) when all of the SFTDS 20 have been resolved by the SDS 5.

During the third step, the MIFFC 10 of the piano audio signal is applied. The filtering block 30 receives each SFTDS 20 and employs a constant-Q filterbank 35 to filter each SFTDS 20 of the signal into N (here, 88) SBTDSs 38, the number of sub-bands being chosen to correspond to the 88 different piano notes. The filterbank 35 similarly uses a series of 88 filter and decimate blocks 36 and spectrum analyzer blocks 31, and a hanning window 32 with a sample rate of 11 kHz.

Each SBTDS 20 is fed through a fast Fourier transform function 33, which converts the signals to SBFTDs 39, which are summed to realize the constant-Q FFC single spectrum 40. The filtering block 30 provides two outputs: an FFT single spectrum 40 and 88 time-domain sub-band signals 38.

The DCQBS block 50 receives these 88 sub-band time-domain signals 38 and calculates the bispectrum for each, individually. The 88 bispectra are then summed to calculate a full, constant-Q bispectrum 54 and then the diagonal of this matrix is taken, yielding the diagonal bispectrum 56. This signal is then multiplied by the single spectrum 40 from the filtering block 30 to yield the product spectrum 60, which is visually represented on a screen (the visual representation is not depicted in FIG. 2).

From the product spectra 60 for each of the SFTDS 20, the user can identify the known audio events (piano notes) played during the 10 second piece. The notes are identifiable because they are matched to specific FFCs of the audio signal 4 and the FFCs are identifiable from the peaks in the product spectra 60 resulting from the third step of the method. This completes the third step of the method.

While a useful method of confirming the known audio events present in an audio event, the masking step 70 is not necessary to identify the known audio events in an audio event because they can be obtained from product spectra 60 alone. In both polyphonic mask building and polyphonic music transcription, the masking step 70, being step four of the method, is of greater importance for higher polyphony audio events (where numerous FFCs are present in the signal).

The mask bank 75 is formed prior to the AERS 1 receiving the 10 second random selection of notes in step one. It is formed by separately recording and calculating the product spectra 60 for each of the 88 piano notes, from the lowest note, A0, to the highest note, C8, and thereby forming a mask for each of these notes. The mask bank 75 illustrated in FIG. 2 has been formed by:

- inputting the product spectrum 60 for each of the 88 piano notes into the masking step 70;
- applying a threshold 71 to the signal by removing amplitudes of the signal that are less than or equal to 0.1× the maximum amplitude of the power spectrum (to minimize the spurious frequency content entering the method);
- applying the quantizing algorithm 72 to the signal so that the frequency axis of the product spectrum 60 is mapped to audio event-specific ranges (here the ranges are related to the frequency ranges, ± a negligible error, associated with MIDI numbers for the piano). This is an important step as higher order harmonics of lower notes are not the same as higher note fundamentals, due to equal-temperament tuning. In this application, the mapping is from frequency (Hz) to MIDI note number;
- the resultant signal is a 108 point array containing peaks at the detected MIDI-range locations; and
- the note masks (88 108-point MIDI pitch arrays) are then stored for application against the recorded random polyphonic piano notes.

The masks are then used as templates to remove frequency content to progressively remove the superfluous harmonic frequency content in the signal to resolve the notes present in each SFTDS 20 of the random polyphonic piano music.

As a concrete example for illustrative purposes, consider the C4 triad chord, D4 triad chord and G4 triad chord referred to in the context of FIG. 2. From the product spectra 60 for each of the three SFTDS 20, the user can identify the three chords played. The notes are identifiable because they are matched to specific FFCs of the audio signal 4 and the FFCs are identifiable from the peaks in the product spectra 60 resulting from the MIFFC 10. Then, in the masking step 70, three peaks in the array are found: MIDI note-number 60 (corresponding to known audio event C4), MIDI note-number 64 (corresponding to known audio event E4), and MIDI note-number 67 (corresponding to known audio event G4). In the presently described application, the method finds the lowest MIDI-note (lowest pitch) peak in the input signal first. Once found, the corresponding mask from the mask bank 75 is selected and multiplied by the amplitude of the input peak. In this case, the lowest pitch peak is C4, with amplitude of ~221 Hz, which is multiplied by the C4 mask.

The adjusted amplitude mask is then subtracted from the MIDI-spectrum output. Finally, the threshold-adjusted output MIDI array is calculated. The mask bank 75 has been iteratively applied to resolve all notes, the end result is empty MIDI-note output array, indicating that no more information is present for the first chord; the method then moves to the next chord, the D4 major triad, for processing; and then to the final chord, the G4 major triad, for processing. In this way, the masking step 70 complements and confirms the MIFFC 10 that identified the three chords being present in the audio signal 4. It is intended that the masking step 70 will be increasingly valuable for high polyphony audio events (such as, where four or more notes are played at the same time).

In step five of the process, the transcription step 80, the final array output 77 of the masking step 70 (constituting a series of MIDI note-numbers) is input into a converter 81 so as to convert the array into a MIDI file 82. This conversion adds the quality of timing (obtained from signal onset and offset times for the SFTDS 20) to each of the notes resolved in the final array to create a consolidated MIDI file. A number of open source and proprietary computer programs can perform this task of converting a note array and timing information into a MIDI file format, including Sibelius, FL Studio, Cubase, Reason, Logic, Pro-tools, or a combination of these programs.

The transcription step 80 then interprets the MIDI file (which contains sufficient information about the notes played and their timing to permit their notation on a musical staff, in accordance with usual notation conventions) and produces a sheet music transcription 84, which visually depicts the note(s) contained in each of the SFTDS 20. A number of open source and proprietary transcribing programs can assist in performing this task including Sibelius, Finale, Encore and MuseScore, or a combination of these programs.

Then, the process is repeated for each of the SFTDSs 20 of the discretized signal produced by the second step of the method, until all of the random polyphonic notes played on the piano (constituting the audio event 3) have been transcribed to sheet music 84.

Figure 3:
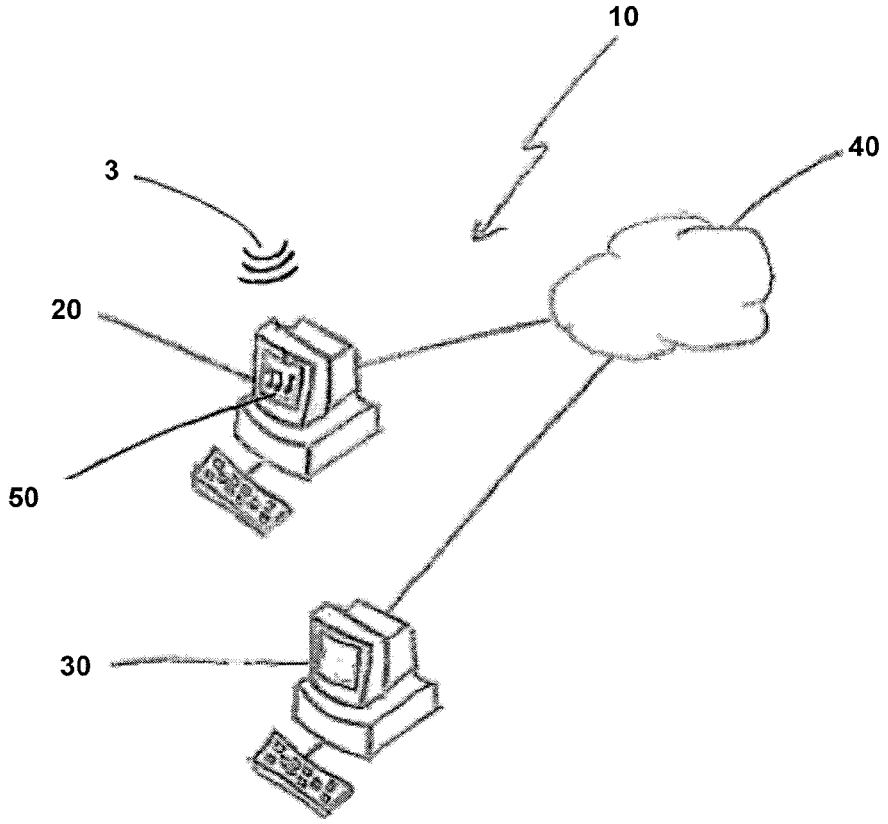
FIG. 3 illustrates a preferred system embodying this disclosure.

FIG. 3 illustrates a computer-implemented system 10, which is a further embodiment of the disclosure. In the third embodiment of the disclosure, there is a system that includes two computers 20 and 30 connected by a network 40. In this system, the first computer is indicated by 20 and the second computer is labeled 30. The first computer 20 receives the audio event 3 and converts it into an audio signal (not shown in FIG. 3). Then, the SDS, MIFFC, MS and TS are performed on the audio signal, producing a transcription of the audio signal (also not shown in FIG. 3). The first computer 20 sends the transcribed audio signal over the network to the second computer 30, which has a database of transcribed audio signals stored in its memory. The second computer 30 is able to compare and match the transcription sent to it to a transcription in its memory. The second computer 30 then communicates over the network 40 to the first computer 10 the information from the matched transcription to enable the visual representation 50 of the matched transcription. This example describes how a song-matching system may operate, whereby the audio event 3 received by the first computer is an excerpt of a musical song, and the transcription (matched by the second computer) displayed on the screen of the first computer is sheet music for that musical song.

Figure 4:
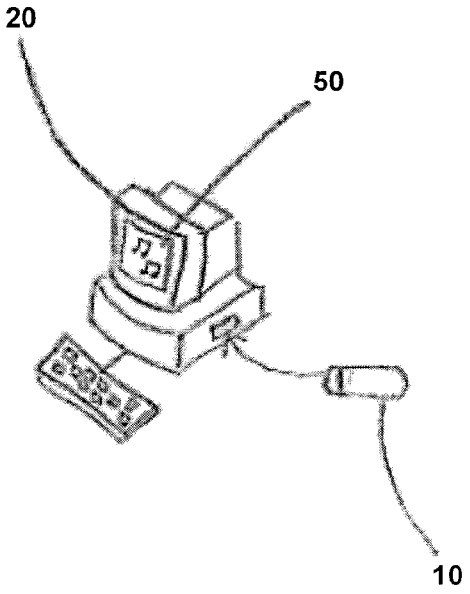
FIG. 4 is a diagram of a computer-readable medium embodying this disclosure.

FIG. 4 illustrates a computer-readable medium 10 embodying this disclosure; namely, software code for operating the MIFFC. The computer-readable medium 10 comprises a universal serial bus stick containing code components (not shown) configured to enable a computer 20 to perform the MIFFC and visually represent the identified FFCs on the computer screen 50.

Throughout the specification and claims, the word "comprise" and its derivatives are intended to have an inclusive rather than exclusive meaning unless the contrary is expressly stated or the context requires otherwise. That is, the word "comprise" and its derivatives will be taken to indicate the inclusion of not only the listed components, steps or features that it directly references, but also other components, steps or features not specifically listed, unless the contrary is expressly stated or the context requires otherwise.

In this specification, the term "computer-readable medium" may be used to refer generally to media devices including, but not limited to, removable storage drives and hard disks. These media devices may contain software that is readable by a computer system and the disclosure is intended to encompass such media devices.

An algorithm or computer-implementable method is here, and generally, considered to be a self-consistent sequence of acts or operations leading to a desired result. These include physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as "values," "elements," "terms," "numbers," or the like.

Unless specifically stated otherwise, use of terms throughout the specification such as "transforming," "computing," "calculating," "determining," "resolving," or the like, refer to the action and/or processes of a computer or computing system, or similar numerical calculating apparatus, that manipulate and/or transform data represented as physical, such as electronic, quantities within the computing system's registers and/or memories into other data similarly represented as physical quantities within the computing system's memories, registers or other such information storage, transmission or display devices. It should be understood, however, that all of these and similar terms are to be associated with the appropriate physical quantities and are merely convenient labels applied to these quantities.

It will be appreciated by those skilled in the art that many modifications and variations may be made to the embodiments described herein without departing from the spirit or scope of the disclosure.

What is claimed is:

1. A method of identifying at least one fundamental frequency component of an audio signal, the method comprising receiving and recording an audio event, and converting the recorded audio event into an audio signal, the method further comprising:

(a) filtering the audio signal to produce a plurality of sub-band time domain signals;

(b) transforming the plurality of sub-band time domain signals into a plurality of sub-band frequency domain signals by mathematical operators;

(c) summing together the plurality of sub-band frequency domain signals to yield a single spectrum;

(d) calculating the bispectrum of each of the plurality of sub-band time domain signals;

(e) summing together the bispectra calculated in (d);

(f) calculating the diagonal of the summed bispectra;

(g) multiplying the single spectrum and the diagonal of the summed bispectra to produce a product spectrum; and (h) identifying at least one fundamental frequency component of the audio signal from the product spectrum or information contained in the product spectrum.

2. The method according to claim 1, wherein at least one identifiable fundamental frequency component is matched with a known audio event such that identification of the at least one fundamental frequency component enables identification of the known audio event.

3. The method according to claim 1, wherein the method further comprises visually representing on a screen or other display means at least one selected from the group consisting of:

the product spectrum;

information contained in the product spectrum;

identifiable fundamental frequency components; and a representation of identifiable known audio events in the audio signal.

4. The method according to claim 1, wherein the product spectrum includes a plurality of peaks, and wherein at least one fundamental frequency component of the audio signal is identifiable from the locations of the peaks in the product spectrum.

5. The method according to claim 1, wherein filtering of the audio signal is carried out using a constant-Q filterbank applying a constant ratio of frequency to bandwidth across frequencies of the audio signal.

6. The method according to claim 5, wherein the filterbank comprises a plurality of spectrum analyzers and a plurality of filter and decimate blocks.

7. The method according to claim 1, wherein the mathematical operators for transforming the plurality of sub-band time domain signals into the plurality of sub-band frequency domain signals comprise fast Fourier transforms.

8. The method according to claim 1, wherein the audio signal comprises a plurality of audio signal segments, and wherein fundamental frequency components of the audio signal are identifiable from product spectra produced by the operation of steps (a) to (g) on the audio signal segments, or from the information contained in such product spectra for the audio signal segments.

9. The method according to claim 1, wherein the audio event comprises a plurality of audio event segments, each being converted into a plurality of audio signal segments, wherein fundamental frequency components of the audio event are identifiable from product spectra produced by operation of steps (a) to (g) of claim 1 on the audio signal segments, or from the information contained in such product spectra for the audio signal segments.

10. The method according to claim 1, wherein the method includes a signal discretization step, and wherein the signal discretization step enables discretizing the audio signal into time-based segments of varying sizes.

11. The method according to claim 10, wherein the segment size of the time-based segment is determinable by the energy characteristics of the audio signal.

12. The method according to claim 1, wherein the method includes a masking step, and wherein the masking step comprises applying a quantizing algorithm to map the frequency spectra of the product spectrum produced in step (g), and a mask bank consisting of a plurality of masks to be applied to the mapped frequency spectra.

13. The method according to claim 12, wherein the quantizing algorithm effects mapping the frequency spectra of the product spectrum to a series of audio event-specific frequency ranges, the mapped frequency spectra together constituting an array.

14. The method according to claim 12, wherein at least one mask in the mask bank contains fundamental frequency spectra associated with at least one known audio event.

15. The method according to claim 14, wherein the fundamental frequency spectra of a plurality of masks in the mask bank is set in accordance with the identified fundamental frequency component.

16. The method according to claim 13, wherein the mask bank operates by applying at least one mask to the array such that the frequency spectra of the at least one mask is subtracted from the frequency spectra in the array, in an iterative fashion from the lowest applicable fundamental frequency spectra mark to the highest applicable fundamental frequency spectra mark, until there is no frequency spectra left in the array below a minimum signal amplitude threshold.

17. The method according to claim 13, wherein the particular masks of the mask bank to be applied to the array are chosen based on which at least one fundamental frequency component(s) are identifiable in the product spectrum of the audio signal.

18. The method according to claim 13, further comprising iterative application of the masking step, wherein iterative application of the masking step comprises performing cross-correlation between the diagonal of the summed bispectra and masks in the mask bank, then selecting the mask having the highest cross-correlation value, the high correlation mask is then subtracted from the array, and this process continues iteratively until no frequency content below a minimum threshold remains in the array.

19. The method according to claim 14, wherein the masking step comprises producing a final array identifying each of the at least one known audio event present in the audio signal, wherein the at least one known audio event identifiable in the final array is determinable by observing which of the masks in the masking step are applied.

20. The method according to claim 19, wherein the method includes a transcription step, and wherein the transcription step comprises converting known audio events, identifiable by the masking step or by the product spectrum, into a visually representable transcription of the identified known audio events.

21. A non-transitory computer-readable medium for identifying at least one fundamental frequency component of an audio signal or audio event, the non-transitory computer-readable medium comprising:

code components configured to enable a computer to perform a method of identifying at least one fundamental frequency component of an audio signal, the method comprising receiving and recording an audio event, and converting the recorded audio event into an audio signal, the method further comprising:

(a) filtering the audio signal to produce a plurality of sub-band time domain signals;

(b) transforming the plurality of sub-band time domain signals into a plurality of sub-band frequency domain signals by mathematical operators;

(c) summing together the plurality of sub-band frequency domain signals to yield a single spectrum;

(d) calculating the bispectrum of each of the plurality of sub-band time domain signals;

(e) summing together the bispectra calculated in (d);

(f) calculating the diagonal the summed bispectra;

(g) multiplying the single spectrum and the diagonal of the summed bispectra to produce a product spectrum; and (h) identifying at least one fundamental frequency component of the audio signal from the product spectrum or information contained in the product spectrum.

* * * * *